US012715485B2

(12) United States Patent
Kimura

(10) Patent No.: US 12,715,485 B2
(45) Date of Patent: Aug. 25, 2026

(54) BOGIE FRAME FOR A RAILWAY VEHICLE

(71) Applicant: Hitachi, Ltd., Tokyo (JP)

(72) Inventor: Sota Kimura, Milan (IT)

(73) Assignee: HITACHI, LTD., Tokyo (JP)

( * ) Notice: Subject to any disclaimer, the term of this patent is extended or adjusted under 35 U.S.C. 154(b) by 485 days.

(21) Appl. No.: 18/378,332

(22) Filed: Oct. 10, 2023

(65) Prior Publication Data

US 2024/0326881 A1 Oct. 3, 2024

(30) Foreign Application Priority Data

Mar. 30, 2023 (EP) ..... 23165637

(51) Int. Cl.
*B61F 5/52* (2006.01)

(52) U.S. Cl.
CPC ..... *B61F 5/523* (2013.01); *B61F 5/526* (2013.01)

(58) Field of Classification Search
CPC .. B61F 5/52; B61F 99/00; B61F 5/526; B61F 5/523
See application file for complete search history.

(56) References Cited

U.S. PATENT DOCUMENTS 12,337,880 B2 * 6/2025 Kimura ..... B61F 1/14
12,337,881 B2 * 6/2025 Kimura ..... B61F 1/12
2022/0144322 A1 * 5/2022 Meier ..... B61F 5/24
2022/0281492 A1 * 9/2022 Kimura ..... B61F 5/04
2022/0332355 A1 * 10/2022 Kimura ..... B61F 1/14
2024/0101164 A1 * 3/2024 Kimura ..... B61D 17/08
2024/0326881 A1 * 10/2024 Kimura ..... B61F 5/523
2026/0035022 A1 * 2/2026 Kimura ..... B61F 5/52

FOREIGN PATENT DOCUMENTS

CN 104554324 A * 4/2015 ..... B61F 5/52
CN 111959550 A * 11/2020 ..... B61F 5/523
CN 115535018 A * 12/2022 ..... B61F 5/52
JP 6144223 B2 * 6/2017
JP 2017128263 A * 7/2017
JP 2023183880 A * 12/2023

* cited by examiner

*Primary Examiner* — S. Joseph Morano
*Assistant Examiner* — Maxwell L Meshaka
(74) *Attorney, Agent, or Firm* — MATTINGLY & MALUR, PC

(57) ABSTRACT

A bogie frame for a railway vehicle, the bogie frame including structural members defining the frame, and one or more reinforcing components joining the structural members, the or each reinforcing component including: a first fibre-reinforced plastic layer having spaced first and second end portions, the first end portion attaching to a first structural member of the bogie frame, and the second end portion attaching to a second structural member of the bogie frame, wherein the first and second structural members are also joined together by one or more fastening bolts; and a second fibre-reinforced plastic layer disposed on a mid part of the first fibre-reinforced plastic layer between its first and second end portions such that the first and second end portions are left uncovered by the second fibre-reinforced plastic layer, wherein a central portion of the reinforcing component that is stronger than the first and second end portions.

12 Claims, 17 Drawing Sheets

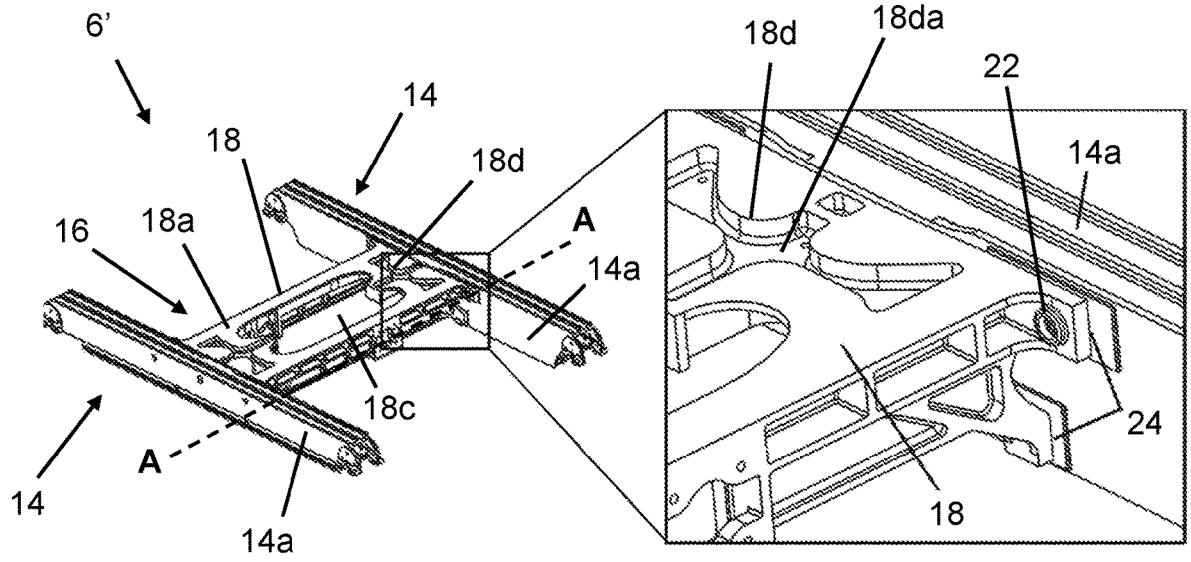
Fig. 2A
Fig. 2B
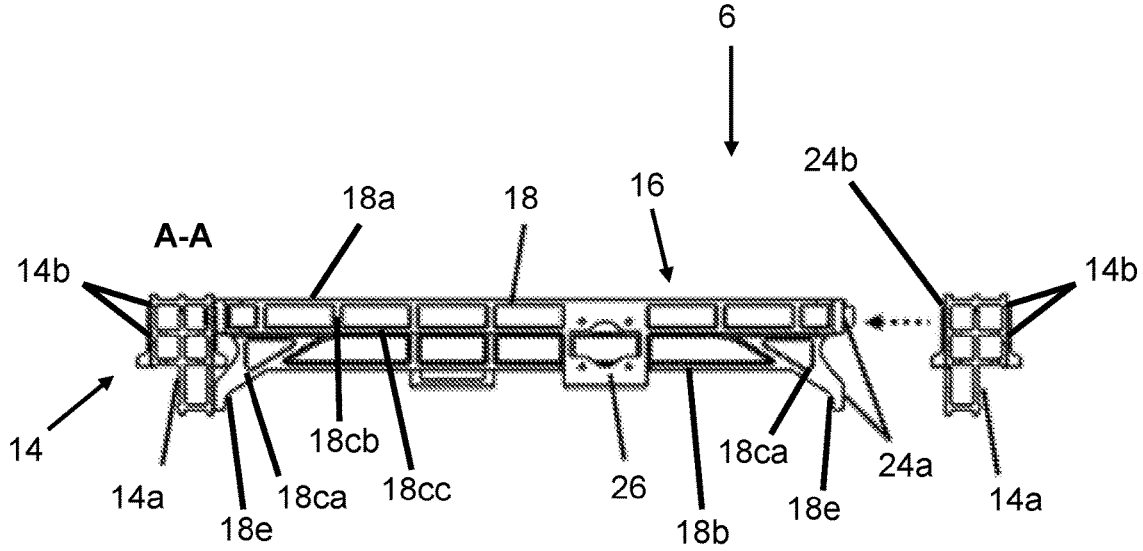
Fig. 2C

BOGIE FRAME FOR A RAILWAY VEHICLE

FIELD OF THE INVENTION

The present invention relates to a bogie frame for a railway vehicle, and a method of monitoring the health of the bogie frame.

CROSS-REFERENCE TO RELATED APPLICATION

The present application claims priority from European application EP23165637.2, filed on Mar. 30, 2023, the content of which is hereby incorporated by reference into this application.

BACKGROUND

Due to increasing societal and political demands for decarbonisation, lightweight construction is a constant concern in machinery structures. Although railway vehicles already provide significant environmental benefits compared to other modes of vehicular transport, structural weight reduction remains an important issue. Lightweight aluminium alloy bogie frames have been proposed to reduce the weight of railway vehicles. However, these structures either contain welded joints or consist of a single casting, which both lead to disadvantages in terms of strength and reliability of the bogie frame.

The use of bolted joints in a bogie frame provides a number of advantages compared to e.g. welded joints. For example, a bolted joint avoids subjecting the bogie frame to residual stresses that may be caused by a welded joint. Also a bolted joint can be easily repaired or replaced. Therefore, the reliability and repairability of the bogie frame can be improved.

Typically, a given bolted joint will include more than one bolt to provide redundancy and spread loads. Therefore, the loosening or failure of a single bolt does not immediately correspond to failure of the whole joint. However, it can be difficult to determine when a bolt has partially or even completely failed if the joint is maintained by the remaining bolt(s), albeit in a weakened arrangement. Essentially, if the loosened or failed bolt is not retightened, repaired or replaced, the load on the remaining bolt(s) is increased and the integrity of the joint as a whole can be compromised.

It would be desirable to provide a way of addressing these issues.

SUMMARY OF THE INVENTION

The present invention has been devised in light of the above considerations.

According to a first aspect of the present invention, there is provided a bogie frame for a railway vehicle, the bogie frame comprising structural members defining the frame, and one or more reinforcing components joining the structural members, the or each reinforcing component comprising:

a first fibre-reinforced plastic layer having spaced first and second end portions, the first end portion attaching to a first structural member of the bogie frame, and the second end portion attaching to a second structural member of the bogie frame, wherein the first and second structural members are also joined together by one or more fastening bolts; and a second fibre-reinforced plastic layer disposed on a mid part of the first fibre-reinforced plastic layer between its first and second end portions such that the first and second end portions are left uncovered by the second fibre-reinforced plastic layer, wherein the second fibre-reinforced plastic layer forms with the mid part of the first fibre-reinforced plastic layer a central portion of the reinforcing component that is stronger than the first and second end portions, and wherein at least the first and second end portions of the first fibre-reinforced plastic layer are transparent or translucent.

In normal operation, the/each fastening bolt and the/each reinforcing component forming the joint between the first and second structural members supports a respective load across the structural members. When a bolt fails, its load transfers to any remaining bolts and to the one or more of the reinforcing components. This load transfer can increase the load across a particular reinforcing component to such an extent that the reinforcing component accumulates damage. However, this damage accumulation will tend to be focused in the first and/or second end portions of the first fibre-reinforced plastic layer as they are weaker than the central portion. Moreover, because the end portions are transparent or translucent, this damage, which is typically in the form of cracks, can be visually identified on inspection of the reinforcing component. In this way, the joint between the first and second structural members can be monitored for partial or complete failure of one or more of the fastening bolts, even while the joint as a whole remains intact, i.e. capable of transmitting loads between the first and second structural members. Partial bolt failure may include loosening and/or plastic deformation of a bolt. Complete bolt failure may include rupture of a bolt into separate parts.

Thus signs of damage in the first and/or second end portions can give an early indication of bolt failure, providing an opportunity to tighten, repair or replace the failed bolt before subsequent failure of any remaining bolts or rupture of the reinforcing component occurs. Therefore, the reliability and safety of the joint can be improved.

The first fibre-reinforced plastic layer may be made of a glass-fibre-reinforced plastic (GFRP), for example, a glass-fibre-reinforced epoxy resin.

The second fibre-reinforced plastic layer may be made of a carbon-fibre-reinforced plastic (CFRP), for example, a carbon-fibre-reinforced epoxy resin.

The/each reinforcing component may extend between the first and second end portions in a direction which is parallel to that of the one or more fastening bolts which join the first and second structural members.

The bogie frame may comprise a plurality of reinforcing components joining the first and second structural members. The plurality of reinforcing components may be spaced (e.g. at regular intervals) in a row along a line of the joint between the first and second structural members. In this configuration, the plurality of reinforcing components can provide a visual indication of how bolt failure is causing the joint to open by the relative amounts, along the row, of damage accumulation in the first and/or second end portions.

Additionally, or alternatively, when the structural members of the bogie frame are joined by a plurality of fastening bolts, the plurality of reinforcing components may be positioned to assist with identification of a failed fastening bolt. More particularly, when a fastening bolt fails, a greater load will generally be transferred to the reinforcing component which is nearest to the failed bolt. Therefore, damage accumulation is more likely to occur in that reinforcing component.

The plurality of reinforcing components may have different mechanical properties, e.g. different strengths. For example, a higher strength reinforcing component may be located at a position where the load transmission between the first and second structural members is greater.

The plurality of reinforcing components may be configured such that each reinforcing component is adjacent to and aligned with a different respective fastening bolt. For example, each reinforcing component may be located to minimise a separation between the reinforcing component and its fastening. In this configuration, damage accumulation in the first and/or second end portion of a given reinforcing component may be an indication of failure of its fastening bolt.

Generally, the first and the second end portions are equal in size. However, the/each reinforcing component may be asymmetric, e.g. the first end portion may be smaller than the second end portion. For example, the first end portion may extend a shorter distance from the central portion than the second end portion. In this configuration, load distribution in the reinforcing component can be such that damage accumulation in the first end portion is more concentrated and therefore easier to visualise than damage accumulation in the second end portion. Conveniently, the first end portion may be located at a more accessible location on the bogie frame, e.g. a location closer to an outer side of the bogie frame, than the second end portion.

The first and second end portions may be adhesively bonded to the first and second structural members, respectively. For example, a structural adhesive such as epoxy, acrylic or urethane may be used to form an adhesive bond. Compared to other fixings, such as mechanical fixings, adhesive bonds are generally lighter and reduce stress concentrations.

The/each reinforcing component is typically formed as a strip, for example in which the first fibre-reinforced plastic layer provides a planar substrate and the second fibre-reinforced plastic layer is bonded to one side of the planar substrate.

The first and/or the second end portion may be divided into a plurality of fingers which attach to the respective structural member. For example, the plurality of fingers may extend in a direction which is parallel to that of the one or more fastening bolts which join the first and second structural members.

The plurality of fingers may be spaced (e.g. at regular intervals) in a row along a line of the joint between the first and second structural members. In this configuration, the plurality of fingers can provide a visual indication of how bolt failure is causing the joint to open by the relative amounts, along the row, of damage accumulation in the fingers.

Additionally, or alternatively, when the structural members of the bogie frame are joined by a plurality of fastening bolts, the plurality of fingers may be positioned to assist with identification of a failed fastening bolt. More particularly, when a fastening bolt fails, a greater load will generally be transferred to the finger nearest to the failed bolt. Therefore, damage is more likely to occur in that finger.

The plurality of fingers of the/each end portion may be separately attached to the respective structural elements. For example, the plurality of fingers may have distinct and separate adhesive bonds with the respective structural member. In this way, interfacial failure of the bond of one of the fingers (e.g. a delamination crack) is less likely to extend into another bond of an adjacent finger leading to similar failure of the other bond.

The/each reinforcing component may further comprise one or more sensors configured to monitor strain in the first and/or second end portions. For example, the one or more sensors can be located at a relatively inaccessible location on the bogie frame, e.g. on one of the first and second end portions which is located further from an outer side of the bogie frame than the other end portion.

When the first and/or the second end portion is divided into a plurality of fingers which attach to the respective structural member, the one or more sensors may be configured to monitor strain in each finger separately. Therefore, the sensors may monitor the type or direction of the load causing the failure of a fastening bolt and/or which fastening bolt has failed.

The/each reinforcing component may further comprise a removable cover configured to protect an exposed surface of one of the first and second end portions. In this way, superficial damage to the exposed surface (e.g. by scratching), or dirt accumulation on the exposed surface, may not hamper the visual identification of damage accumulation in the/each end portion. Conveniently, both end portions may be protected by respective removable covers.

When the first and/or second end portion comprises the plurality of fingers, each of the fingers may further comprise respective removable covers each configured to protect an exposed surface of its finger.

The first structural member may be one of a pair of side members of the bogie frame, e.g. the side members may extend in a longitudinal direction of the railway vehicle. Conveniently, the side members may be extrusions, e.g. made of an aluminium alloy. The extrusion direction may be along the longitudinal direction.

The second structural member may be a centre member which extends between the pair of side members, e.g. the centre member may extend between the side members in a transverse direction of the railway vehicle, perpendicular to its longitudinal direction. The centre member may be a metal casting, e.g. an iron-based casting or an aluminium alloy casting.

According to a second aspect of the present invention, there is provided a method of monitoring the health of the bogie frame according to the first aspect, the method including:

inspecting either or both of the transparent or translucent end portions of the reinforcing component for damage to the first fibre-reinforced plastic layer in the end portions; and determining that the joint between the first and second structural members is deteriorating when damage to the first fibre-reinforced plastic layer in the end portions is detected.

As mentioned above, joint deterioration can be caused by failure of at least one of the fastening bolts. Thus the method may further include identifying a partially or completely failed fastening bolt as the cause of joint deterioration.

When the reinforcing component comprises the removable cover(s), the inspection step may include removing the/each removable cover from the/each end portion or from one or more of the plurality of fingers.

When the first and/or second end portion comprises the plurality of fingers, the inspection step may include comparing amounts of any damage to respective fingers.

Additionally, or alternatively, when the bogie frame comprises a plurality of reinforcing components, the inspection step may include comparing amounts of any damage to respective end portions of the components.

The invention includes the combination of the aspects and preferred features described except where such a combination is clearly impermissible or expressly avoided.

SUMMARY OF THE FIGURES

Embodiments and experiments illustrating the principles of the invention will now be discussed with reference to the accompanying figures in which:

FIG. 2A shows a schematic of an example bogie frame in a perspective view;

FIG. 2B shows an enlarged section of the bogie frame depicted in FIG. 2A, illustrating an example of a bolt connection between a side member and centre member;

FIG. 2C shows the bogie frame of FIG. 2A in a front and a section view, respectively;

DETAILED DESCRIPTION OF THE INVENTION

Further background to the present invention, and aspects and embodiments of the present invention will now be discussed with reference to the accompanying figures. Further aspects and embodiments will be apparent to those skilled in the art. All documents mentioned in this text are incorporated herein by reference.

Figure 1:
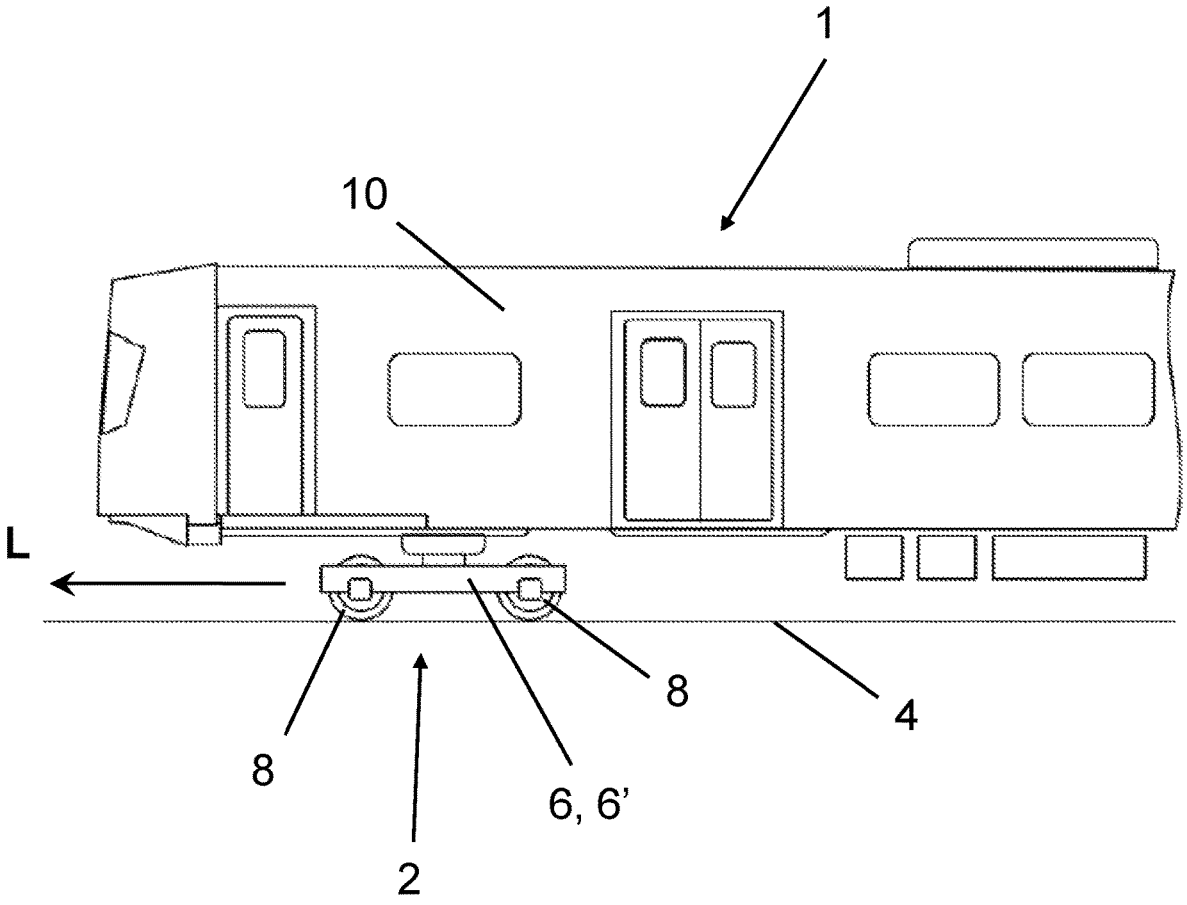
FIG. 1 shows a schematic side-view of a railway vehicle including a bogie.

FIG. 1 shows a schematic side-view of a railway vehicle 1 including a bogie 2. The bogie 2 is positioned underneath the railway vehicle 1 over the track 4. The bogie 2 comprises a bogie frame 6, 6' for supporting the railway vehicle 1. The bogie frame 6, 6' is coupled to a set of wheels 8 via respective axles (not shown).

Usually, two bogies (not shown) are fitted to each car body 10 of the railway vehicle 1, one near each end of the car body 10. However, the bogie 2 may be disposed between adjacent car bodies 10. The bogie 2 is important for providing stability to the railway vehicle 1 by absorbing strong vibrations and high centrifugal forces, particularly on curved sections of the track 4.

FIG. 2A shows an example of a bogie frame 6' in a perspective view. The depicted bogie frame 6' comprises two side members 14 and a centre member 16. The depicted straight side members 14 include extruded profiles 14*a* made of an aluminium alloy. Preferably, the aluminium alloy may be an aluminium alloy of the 6xxx series. The extrusion direction of the extruded profiles 14*a* is arranged in a longitudinal direction L of the railway vehicle 1 when the bogie frame 6' is mounted thereto.

The depicted centre member 16 comprises a cast element 18 being a cast multi-chamber element 18 which may be made from metal casting. In the depicted examples of the centre member 16 shown in FIGS. 2A to 8, the entire centre member 16 is a cast element 18 being a multi-chamber element 18.

However, it may also be possible that only a part of the centre member 16 consists of a cast multi-chamber element 18 and further parts thereof may have other designs.

For example, the cast material of the multi-chamber element 18 may be iron-based or aluminium alloy. Preferably, the cast material may be an aluminium alloy. The depicted centre member 16 has an opening 18*c* in a top view, which is arranged symmetrically to a longitudinal axis of the centre member 16. By arranging the opening 18*c* as shown in FIG. 2A, the centre member 16 comprises two facing cross beams which are connected to each other at the sides of the centre member 16 adjacent to the extruded profiles 14*a*. This may allow for a uniform distribution of the lateral loads to be absorbed by the bogie frame 6'.

In the upper surface 18*a* of the cast multi-chamber element 18 there are provided two recesses 18*d* for receiving first strengtheners 20, the bottom 18*da* of which lies in a plane parallel to the upper surface 18*a*. The insertion of the first strengtheners 20 into the recesses 18*d* will be described later in connection with FIGS. 6A and 6B.

FIG. 2B shows an enlarged section of the bogie frame 6' depicted in FIG. 2B illustrating an example of a bolt connection 22 between the side members 14 and the centre member 16. In particular, FIG. 2B depicts two contact surfaces 24 at which the side member 14 is jointed to the centre member 16. The depicted side member 14 is connected to the centre member 16 at the contact surfaces 24 by means of the bolt connection 22.

FIG. 2C shows the centre member 16 of the bogie frame 6' of FIG. 2C in a front view and the extruded profiles 14*a* of the side members 14 in a section view along the line A-A depicted in FIG. 2C. In this view, the plurality of chambers included in the multi-chamber element 18 is clearly visible. It can be seen that the chambers are formed, e.g., by ribs 18*cb*, 18*cc* disposed perpendicularly and parallel to the upper and lower surfaces 18*a*, 18*b* of the multi-chamber element 18. In addition, two inclined ribs 18*ca* are visible, which form a transition to the short side arms 18*e* of the multi-chamber element 18 being U-shaped in longitudinal section. The two inclined ribs 18*ca* may be arranged at a predetermined angle to the lower surface 18*b* of the multi-chamber element 18. Moreover, contact surfaces 24*a* are provided on each of the outward-facing sides of the side arms 18*e*.

Another contact surface 24*a* is provided adjacent to the upper surface 18*a* of the multi-chamber element 18 on both sides thereof facing a contact surface 24*b* of the extruded profile 14*a*. Further, one can recognize a fastening element 26 at a front side of the centre member 16, which is integrated in the cast structure of the multi-chamber element 18. This fastening element 26, may be an element for connecting the bogie frame 6' to a centre pin (not depicted) mounted on the car body 10.

Furthermore, it can be derived from FIG. 2C that the extruded profile 14*a* of the side member 14 comprises a plurality of hollow profiles 14*b* which may be obtained from a single extrusion process. In the depicted case, each extruded profile 14*a* includes five hollow profiles 14*b*. The extruded profiles 14*a* may be arranged at the railway vehicle 1 such that its extrusion direction is along the longitudinal direction L of the railway vehicle 1. This allows for providing side members 2 having a lightweight structure with high bending stiffness.

An advantage of the bogie frame 6' shown in the FIGS. 2A to 2C is that its arrangement corresponds to the multi-directional loads it must withstand. Since the side members 14 must withstand the bending load applied by the weight of the car body 10, the extruded profile 14*a* shown in FIG. 2C is suitable for achieving the lightweight structure with high bending stiffness. On the other hand, the centre member 16 must withstand not only the bending load but also lateral and torsion loads. Therefore, a more complex shape such as the U-shaped longitudinal section with multiple chambers shown in FIG. 2C is desirable, which can be provided by a casting process. In addition to saving weight, the depicted bogie frame 6' reduces the number of the single parts by incorporating fastening elements 26 into the cast structure.

Figure 3A:
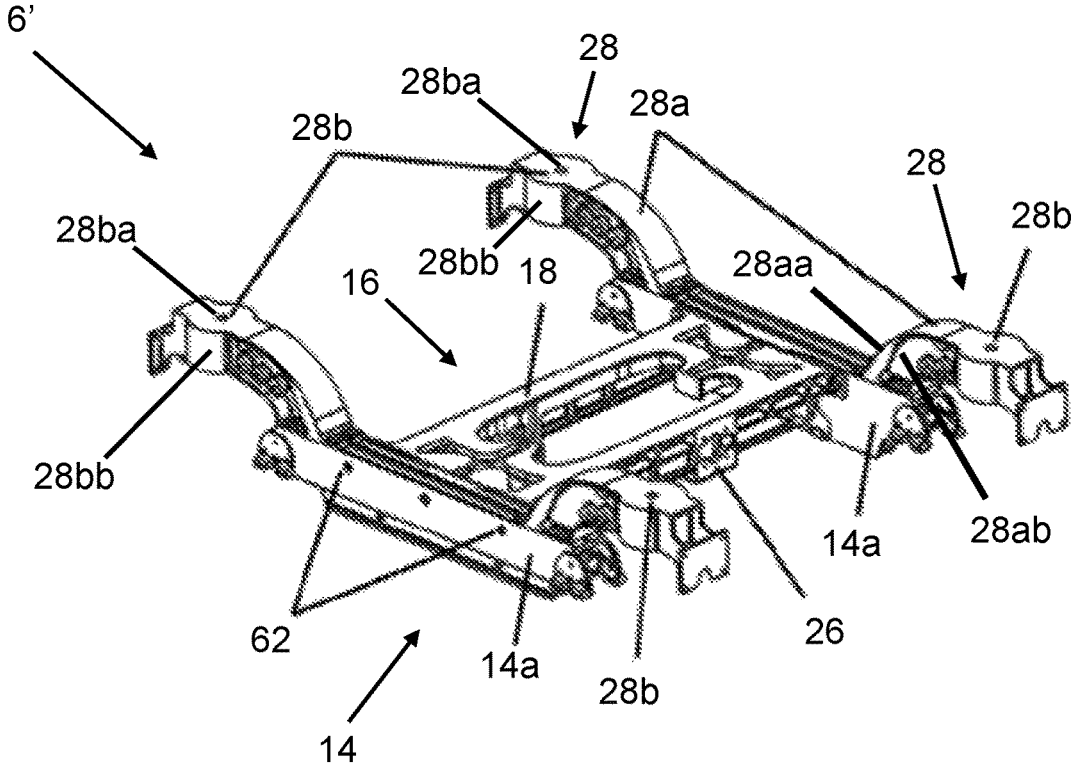
FIG. 3A shows the bogie frame of FIG. 2A including additional elements.
Figure 3B:
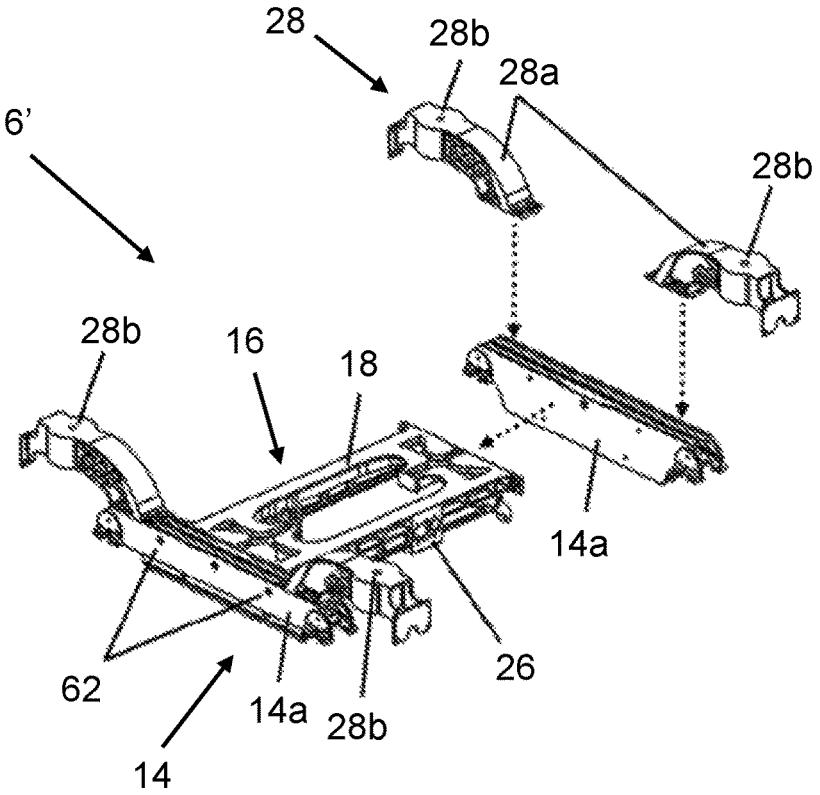
FIG. 3B shows the bogie frame of FIG. 3B in an exploded view.

FIG. 3A shows the bogie frame 6' including side members 14 with cast curved elements 28. FIG. 3B shows the bogie frame 6' of FIG. 3A in an exploded view.

In this example, each side member 14 comprises a straight extruded profile 14*a* and two cast curved elements 28 made from metal casting. The depicted straight extruded profiles 14*a* include a plurality of holes 64 for connecting them with the centre member 16 by bolt connections (fastening bolts) 62 (cf. FIG. 2B). The depicted cast curved elements 28 can be jointed to the straight extruded profiles 14*a* by a bolt connection 42 or the adhesive bond at joining points 34, which will be further described in connection with FIGS. 4 and 5.

For example, the cast curved elements 28 may be made of iron or aluminium alloy. Preferably, the cast curved elements 28 may be made of an aluminium alloy. Most preferably, the aluminium alloy may be a cast alloy of the 7x xx.x series.

Figure 4:
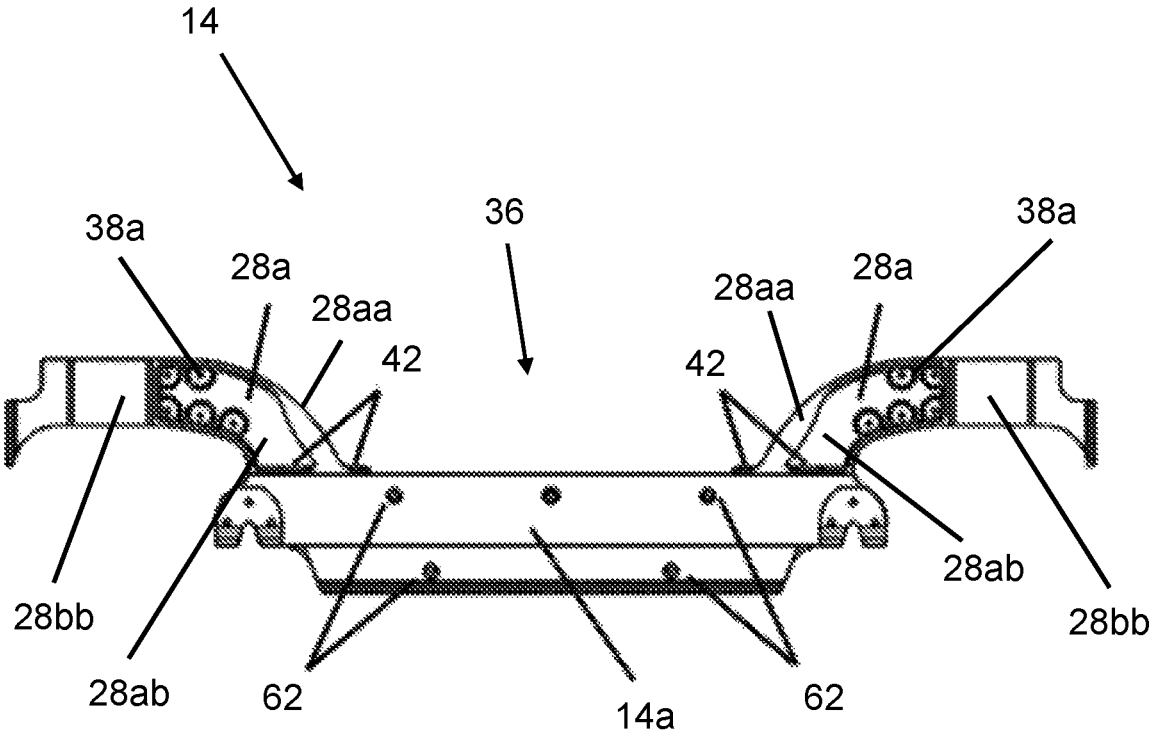
FIG. 4 shows the bogie frame of FIG. 3A in a side view.

The cast curved elements 28 shown in FIGS. 3A and 3B include a first section 28*a*, formed as an open hollow profile 28*aa* with lateral openings 28*ab* on both sides, the first section 28*a* having an arcuate shape in longitudinal section (cf. also FIG. 4). Furthermore, the cast curved elements 28 comprise a second section 28*b* adjacent to the first section 28*a*, which is formed as a closed hollow profile 28*bb* having a rectangular longitudinal section. The second section 28*b* includes an integrated receptacle 28*ba* for receiving at least one wheel 8 of the railway vehicle 1.

In other words, the curved element 28 comprises an integrated connecting part 28*ba* that allows the curved element 28 to be coupled to at least one wheel 8 of the railway vehicle 1. This means that cast curved elements 28 allow the bogie frame 6' to be connected to the set of wheels 8 via the integrated connecting parts 28*ba*.

As visible in FIG. 3B, the cast curved element 28 is connected to the extruded profile 14*a* of the side member 14 by joining an outer end of the first section 28*a*, disposed opposite to an end adjacent to the second section 28*b*, to an outer end of the extruded profile 14*a*. Since the cast curved elements 28 are jointed to the extruded profile 14*a* by a bolt connection 22 and/or an adhesive bond, stresses due to welded joints can be avoided, allowing an improvement in the mechanical strength and stiffness of the bogie frame 6'.

FIG. 4 shows the bogie frame 6' of FIG. 3A in a side view. In this view it becomes apparent that the depicted side member 14, which comprises a straight extruded profile 14*a* and two cast curved elements 28, allocates a space 36 between the bogie 2 and the car body 10 in which electric sensors and structural components of the railway vehicle 1 may be arranged. Additionally, the shape of the cast curved elements 28 including a first section 28*a* and a second section 28*b*, as described in connection with FIGS. 3A and 3B, is clearly visible in the side view of FIG. 4. Inside the open profile 28*aa* of the first section 28*a*, joining points 38*a* are disposed for attaching strengtheners 38 to the curved element 28.

Furthermore, the position of the joining points 38*a*, at which the cast curved element 28 is connected to the extruded profile 14*a*, is depicted in FIG. 4. It can be seen, that in case of bolt connections 42 at these joining points 38*a*, the position has to be adjusted to avoid interference with the holes 64 for bolt connection between the side members 14 and the centre member 16.

Figure 5:
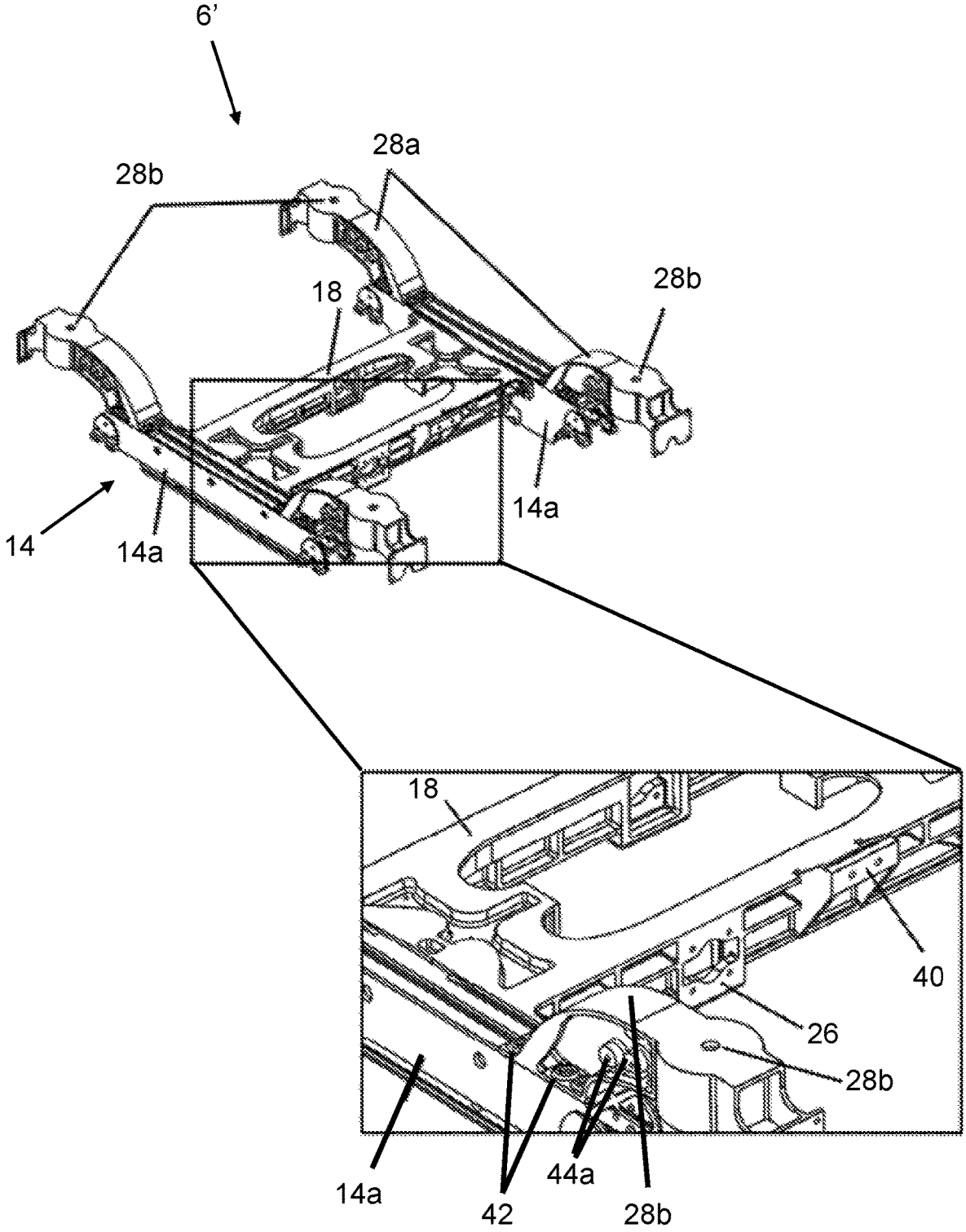
FIG. 5 shows an enlarged section of the bogie frame depicted in FIG. 3A illustrating examples of integrated fastening elements.

FIG. 5 shows an enlarged section of the bogie frame 6' depicted in FIG. 3B illustrating examples of integrated fastening elements 26, 40. Beside the integrated fastening element 26, which may be used for connecting the bogie frame 6' to the centre pin (not depicted), a further bracket 40 is shown in FIG. 5, which may be used for attaching the motors (not shown) or the brakes (not shown) of the railway vehicle 1 to the bogie frame 6'. The depicted bogie frame 6' enables an improvement in mechanical strength and stiffness at the interface of the bracket 40 and the fastening element 26 to the centre member 16, as these elements 26, 40 can already be formed during casting, so that no subsequent welding is necessary.

Furthermore, the enlarged section of the bogie frame 6' shown in FIG. 5 illustrates the joining points with the respective bolt connections 42 for coupling the curved element 28 to the extruded profile 14*a*. Furthermore, joining points for attaching strengtheners 38 to the curved element 28 can be seen, which are described in more detail in the following FIGS. 6A-6C.

Figure 6A:
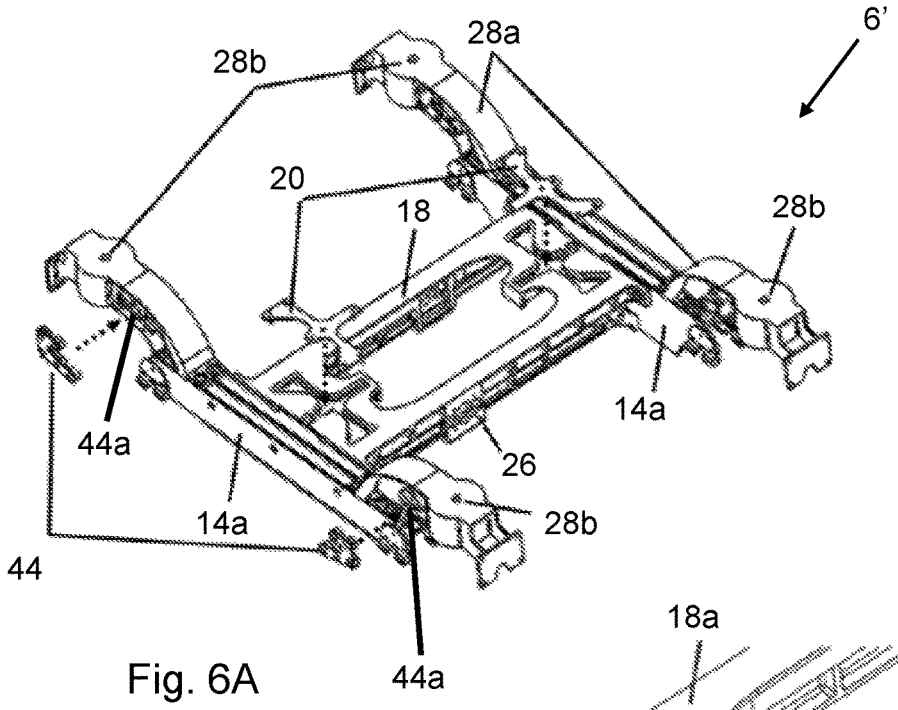
FIGS. 6A-6C show examples of a first strengthener attachable to the bogie frame of FIG. 3A.
Figure 6B:
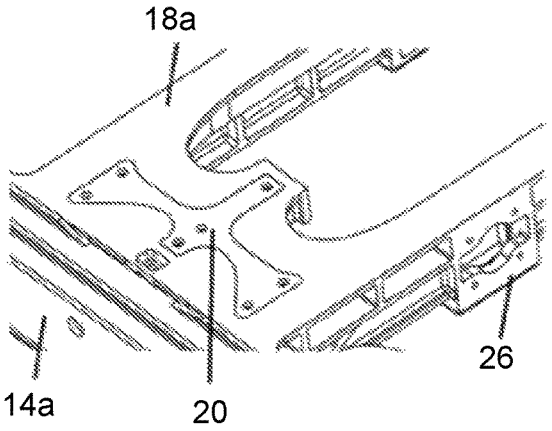
Figure 6C:
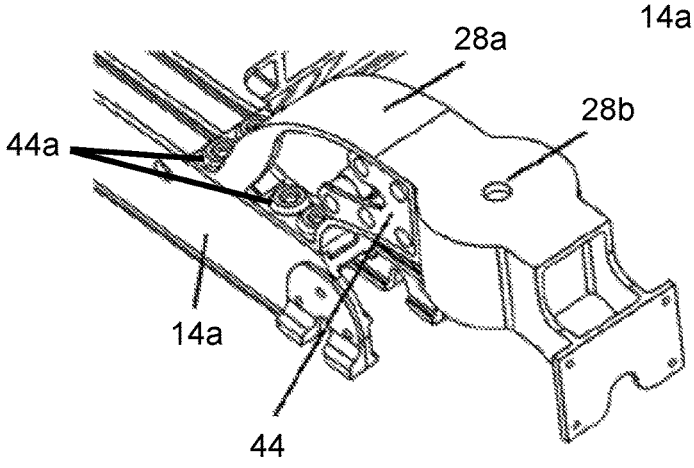

FIG. 6A-6C show examples of a first strengthener 20, 44 attachable to the bogie frame 6'. In particular, FIG. 6A shows an exploded view of exemplary strengtheners 44 and exemplary first strengtheners 20 which can be attached to the cast curved element 28 and the cast multi-chamber element 18, respectively. FIG. 6B shows an example of a first strengthener 20 embedded in the upper surface 18*a* of the multi-chamber element 18 of the centre member 16, and FIG. 6C shows an example of a strengthener 44 attached to the cast curved element 28 of the side member 14.

The depicted strengthener 44 is a flat element which can be inserted into the cast structure of the curved element 28 of the side member 14 (cf. FIG. 6C). Since the depicted cast curved element 28 is designed as an open profile, the stiffness of the curved element 28 can be increased by inserting the flat reinforcing element 44 thereto.

Each strengthener 44 may be fixed to the respective cast curved element 28 by a bolt connection via the joining points 44*a*. It may be also possible to fix the strengtheners 44 to the cast curved elements 28 by means of adhesive bonds. The strengthener 44 may be made of steel and/or carbon fibre-reinforced plastic (CFRP). The strengtheners 44 may be produced using a casting process or any other suitable production process.

The depicted first strengtheners 20 are also flat elements having approximately the form of a bird. They are inserted into a recess 18*d* provided in the upper surface 18*a* of the multi-chamber element 18 such that it forms a flat surface with the latter (cf. FIG. 6B). To achieve this flat surface, a shape of the recess 18*d* in a plane parallel to the upper or lower surface 18*a*, 18*b* may correspond to a shape of the first strengthener 20 in longitudinal and transverse directions thereof, and a depth of the recess 18*d* may correspond to a thickness of the first strengthener 20.

Having a "bird shape" means for the first strengthener 20 to extend longitudinally and transversely of the railway vehicle 1 when inserted into the recess 18*d* in the upper surface 18*a* of the multi-chamber element 18*a*. In this case, an extension in the longitudinal direction L of the railway vehicle 1 is larger than an extension in the transverse direction thereof. Furthermore, the "bird shape" of the first strengthener 20 results in a symmetrical shape of the extension in the longitudinal direction L of the railway vehicle 1, wherein a width of the extension in this longitudinal direction L increases with increasing distance from a transverse axis of the first strengthener 20.

The "bird shape" may, for example, be achieved by forming an outer contour of the first strengthener 20 in a top view such that an outer contour of a side thereof facing an outside of the centre member 16 in the longitudinal direction L of the railway vehicle 1 has a W-shape and an outer contour of an opposite side has a T-shape, wherein the bottom of the W and the top of the T are facing each other (cf. also FIG. 2B). Opposite ends of the T-shaped and W-shaped outer contour may be connected to each other by a straight line, to complete the entire outer contour of the first strengthener 20 (and the corresponding recess 18*d*).

Inserting the first strengthener 20, having approximately the form of a bird in a top view, in a recess 18*d* in the upper surface 18*a* of the multi-chamber element 18 further increases the stiffness thereof without limiting the space required for mounting the components of the railway vehicle 1.

The first strengtheners 20 may also be made of steel and/or CFRP. They may be fixed to the centre member 16 by bold connections and or adhesive bonds. The first strengtheners 20 may be produced using a casting process or any other process appropriate to create the specific shape of the first strengthener 20.

Figure 7:
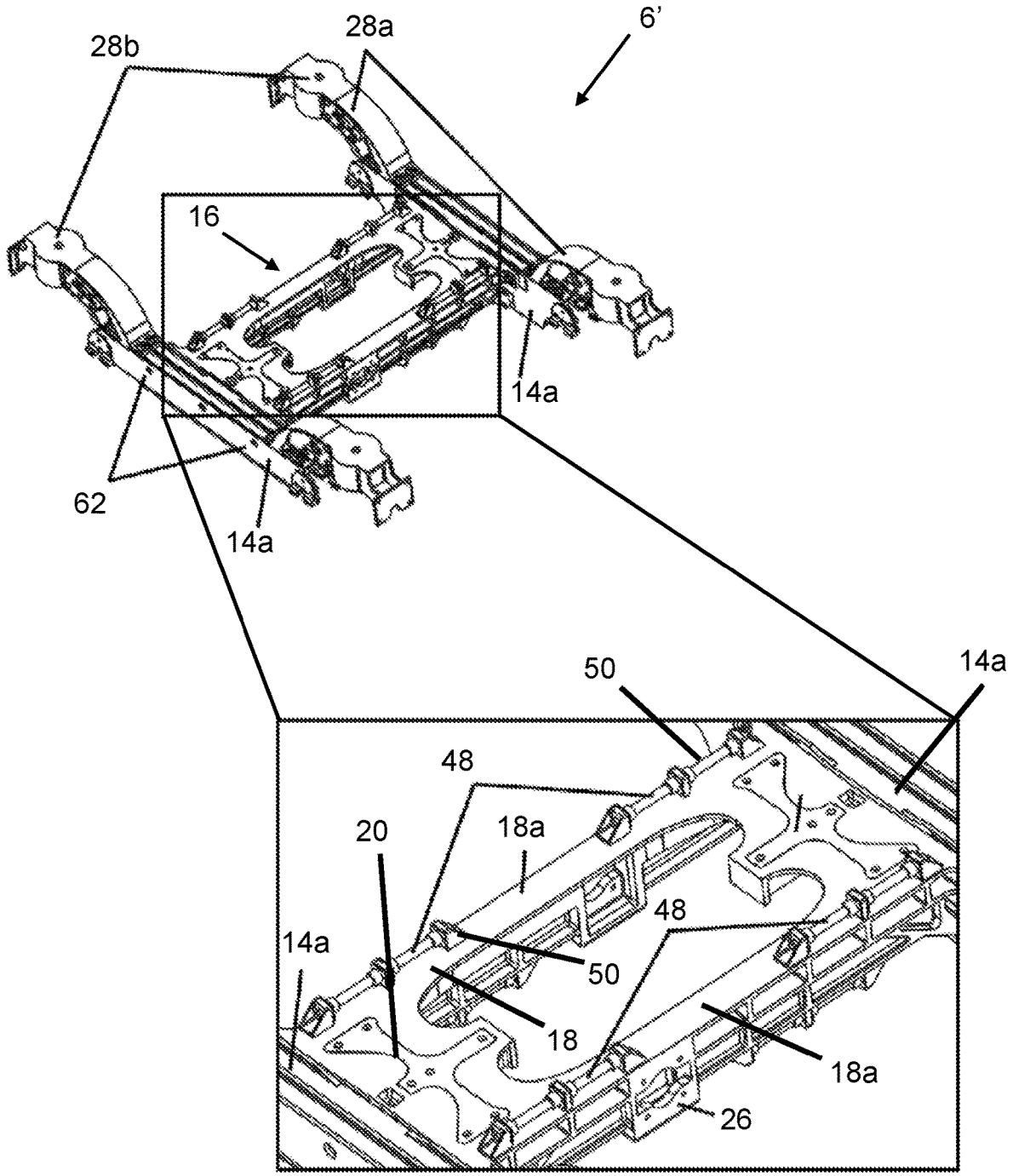
FIGS. 7-8 show examples of a second strengthener attachable to the bogie frame of FIG. 3A.
Figure 8:
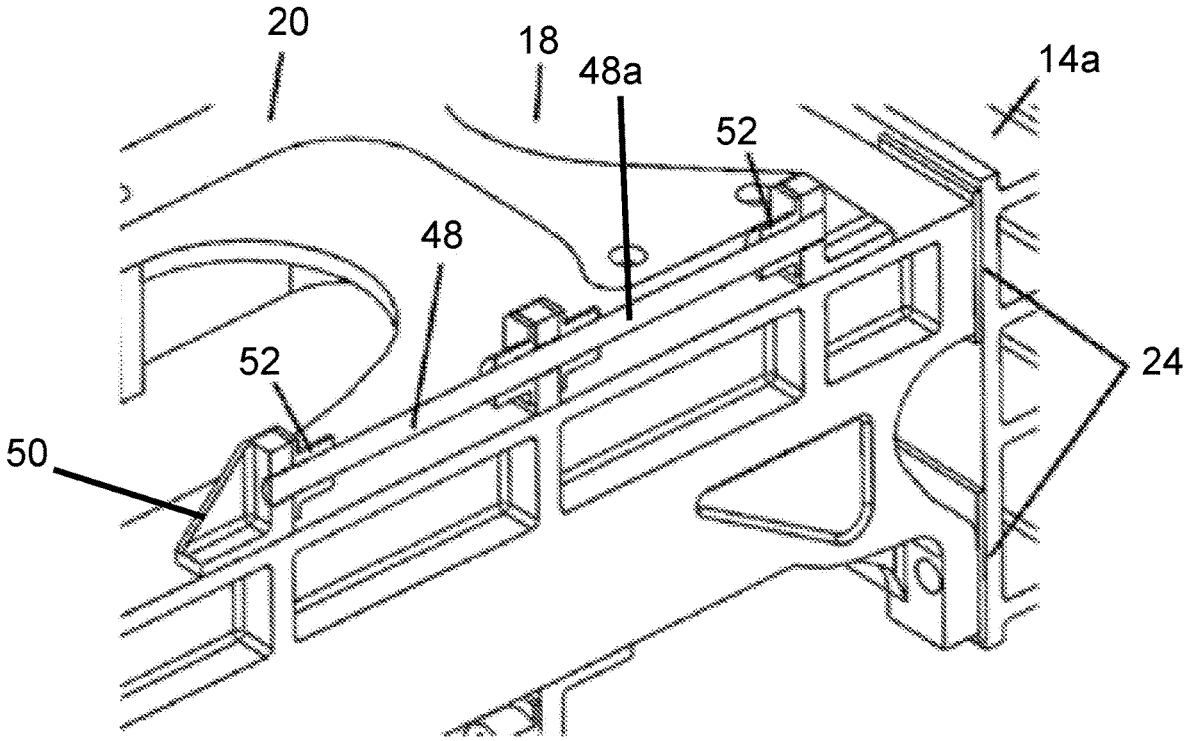

FIGS. 7 and 8 show examples of a second strengthener 48 attachable to the bogie frame 6'.

In particular, FIG. 7 shows an enlarged section of the centre member 16 to which second strengtheners 48 are attached. The second strengtheners 48 include struts 48*a*, having a cylindrical cross section, which are mounted with mounting brackets 50 on the upper surface 18*a* of the multi-chamber element 18.

The struts 48*a* extend in longitudinal direction of the centre element 16, which means they can increase the stiffness in lateral direction of the bogie frame 6'. In the presented case, each second strengthener 48 uses three mounting brackets 50 to keep the struts 48*a* in the desired position. The second strengtheners 48 may be connected via the mounting brackets to the upper or lower surface 18*a*, 18*b* of the cast multi-chamber element 18 by a bolt connection and/or an adhesive bond.

Preferably, the second strengtheners 48 may be made of CFRP. This allows for increasing the stiffness of the centre member 16 without increasing its weight significantly.

FIG. 8 depicts a further example of the second strengthener 48 which uses elastic adhesive bonds 52 having high damping properties to mount the second strengthener 48 on the upper surface 18*a* of the multi-chamber element 18. Especially, the struts 48*a* of the second strengthener 48, having a rectangular cross section, are equipped with the elastic adhesive bonds 52 via which the struts 48*a* are fixed to the mounting brackets 50.

Furthermore, the brackets 50 may also be fixed to the upper surface 18*a* of the multi-chamber element 18 via elastic adhesive bonds (not shown). The damping effect of the elastic adhesive material can contribute to absorption of the vibration and noise when transmitting through the bogie frame 6'. In addition, the bonding with the elastic adhesive can contribute to reduction of the thermal stress induced by the mismatch of the thermal properties between the CFRP and the cast material of the multi-chamber element 18. This results in improved mechanical strength and stiffness at the adhesive bond area on the upper surface 18*a* of the multi-chamber element 18.

Figure 9:
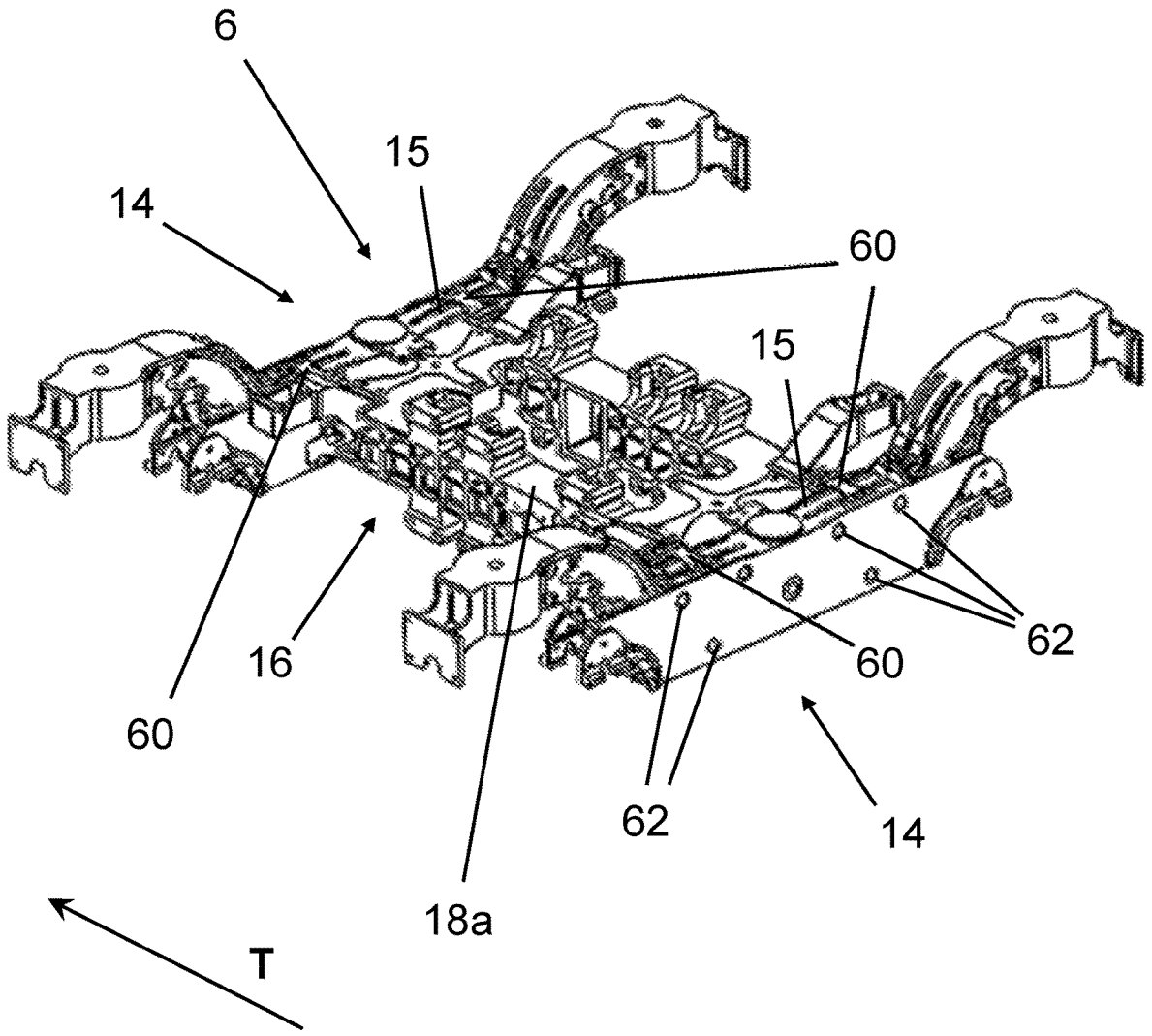
FIG. 9 shows a schematic drawing of a bogie frame which is a development of the bogie frame of FIG. 3A, including a plurality of reinforcing components.

FIG. 9 shows a schematic drawing of a second bogie frame 6 which is a development of the first bogie frame 6' described above. Features of the second bogie frame 6 corresponding to those of the first bogie frame 6' are referred to herein and in the accompanying Figures by the same reference characters. Compared to the first bogie frame 6', the second bogie frame 6 is shown in FIG. 9 with additional equipment mounted on the centre member 16. Significantly, the second bogie frame 6 also includes a plurality of reinforcing components 60. The reinforcing components 60 are different from the strengtheners 20, 44, 48 in that the reinforcing components 60 strengthen the joints between the side members 14 and the centre member 16, whereas the strengtheners 20, 44, 48 strengthen the respective side members 14 and centre member 16 individually. The centre member 16 is bolted to the pair of side members 14 via a plurality of fastening bolts 62. Each of the pair of side members 14 may be considered "a first structural member 14" of the bogie frame 6, and the centre member 16 may be considered "a second structural member 16" of the bogie frame 6.

Although the fastening bolts 62 are configured to receive most of the load between the side members 14 and the centre member 16, the side members 14 are also joined to the centre member 16 by the reinforcing components 60, which extend between the side members 14 and the centre member 16 in the transverse direction T of the railway vehicle 1, which is substantially parallel to the direction of the fastening bolts 62. Specifically, in FIG. 9 there are four reinforcing components 60, with one at each corner of the centre member 16, whereby each side member 14 is joined to the centre member 16 by a pair of the reinforcing components 60.

In normal operation, each fastening bolt 62 and each reinforcing component 60 forms a joint between the structural members 14, 16 and supports a respective load across the structural members 14, 16. If one of the fastening bolts 62 partially or completely fails, its load transfers to the remaining bolts 62 and to the reinforcing component(s) 60 across the same joint. This load transfer can increase the load across a particular reinforcing component 60 to such an extent that visible damage accumulates on that reinforcing component 60, as discussed in more detail below. In this way, the joints between the side members 14 and the centre member 16 can be monitored for failure of the fastening bolts 62, even when most of the fastening bolts 62 have not failed and the joint as a whole appears to be fully intact and capable of transmitting the necessary loads between the structural members 14, 16. Therefore, the visible damage gives an early indication that a fastening bolt 62 has failed, providing an opportunity to tighten, repair or replace the failed bolt 62 before subsequent failure of any of the remaining bolts 62 or rupture of either of the reinforcing components 60 occurs.

Figure 10:
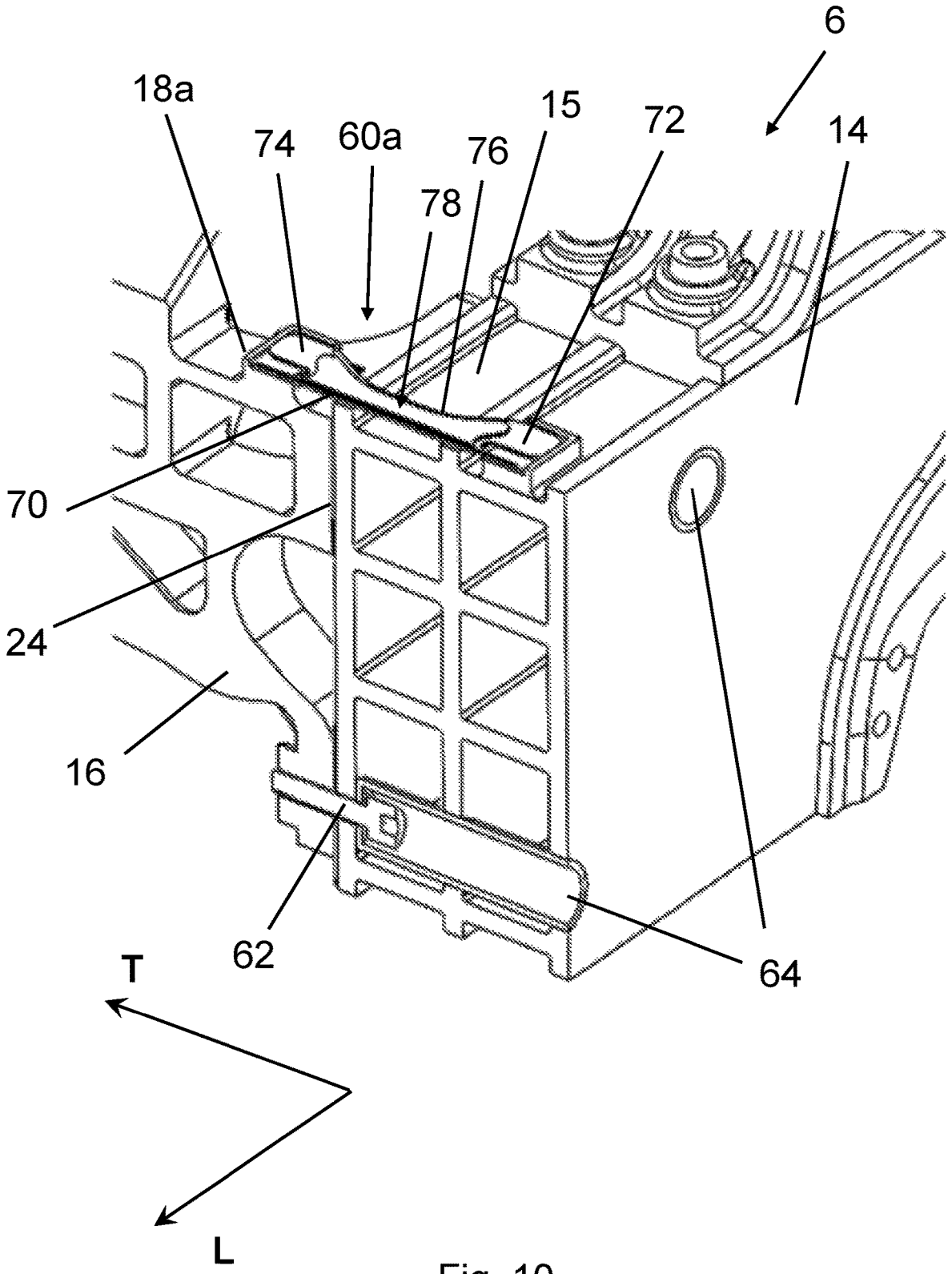
FIG. 10 is a cross-sectional view of part of the bogie frame of FIG. 9, showing a fastening bolt and a reinforcing component.

FIG. 10 is a cross-sectional view of part of the bogie frame 6. The cross-section lies in a plane normal to the longitudinal direction L and bisects one of the fastening bolts 62 and one of the reinforcing components 60. The reinforcing component 60 can be seen to be attached to an upper surface 18*a* of the bogie frame 6, where it is adjacent to and aligned with the fastening bolt 62 in order to minimise the separation between the reinforcing component 60 and the fastening bolt 62.

In this configuration, failure of the particular fastening bolt 62 can be identified with more certainty. In particular, if the reinforcing component 60*a* is visibly more damaged than the other reinforcing component 60 on the same side of the centre member 16, it is more likely that the damage was caused by failure of the particular fastening bolt 62 rather than other more distant fastening bolts.

Each reinforcing component 60 is formed as a strip and comprises a planar, first fibre-reinforced plastic layer 70 having a first end portion 72 and a second end portion 74, the first 72 and second 74 end portions being spaced in the direction T. The first end portion 72 is attached to a platform formed on an upper surface 15 of the side member 14 (first structural member 14). The second end portion 74 is attached to a platform formed on an upper surface 18*a* of the centre member 16 (second structural member 16).

The first end portion 72 and the second end portion 74 are adhesively bonded to their platforms on the side member 14 and the centre member 16, respectively. A structural adhesive such as epoxy, acrylic or urethane can be used to form the adhesive bond. The adhesive bond is generally lighter than an equivalent mechanical fixing and reduces stress concentrations in the reinforcing component 60 and the structural members 14, 16.

The reinforcing component 60 further comprises a second fibre-reinforced plastic layer 76 disposed on a mid part of the first fibre-reinforced plastic layer 70 between its first end portion 72 and its second end portion 74 such that the first and second end portions 72, 74 are left uncovered by the second fibre-reinforced plastic layer 76. The second fibre-reinforced plastic layer 76 forms with the mid part of the first fibre-reinforced plastic layer 70 a central portion 78 of the reinforcing component 60 that is stronger than the first and second end portions 72, 74.

Additionally, the first 72 and second 74 end portions of the first fibre-reinforced plastic layer 70 are transparent or translucent. Preferably, the first fibre-reinforced plastic layer 70 is made of glass fibre-reinforced plastic (GFRP), e.g. a glass-fibre-reinforced epoxy resin, which is inherently translucent. Preferably, the second fibre-reinforced plastic layer 76 is made of a carbon-fibre-reinforced plastic (CFRP), e.g. a carbon-fibre-reinforced epoxy resin.

In FIG. 10, the mid part of the first fibre-reinforced plastic layer 70 and second fibre-reinforced plastic layer 76 narrow to a central waist. In addition, the first 72 and second 74 end portions are each divided into two fingers (although being bisected on the cross-sectional view of FIG. 10, only one finger of each end is actually shown in FIG. 10). Such features are discussed below in more detail in respect of FIG. 15. However, FIG. 11 shows a schematic drawing of a simpler version of the reinforcing component 60 in which the first fibre-reinforced plastic layer 70 is a simple rectangle, and the second fibre-reinforced plastic layer 76 is a further simple rectangle, centrally disposed on the mid part of the first fibre-reinforced plastic layer 70.

Figure 11:
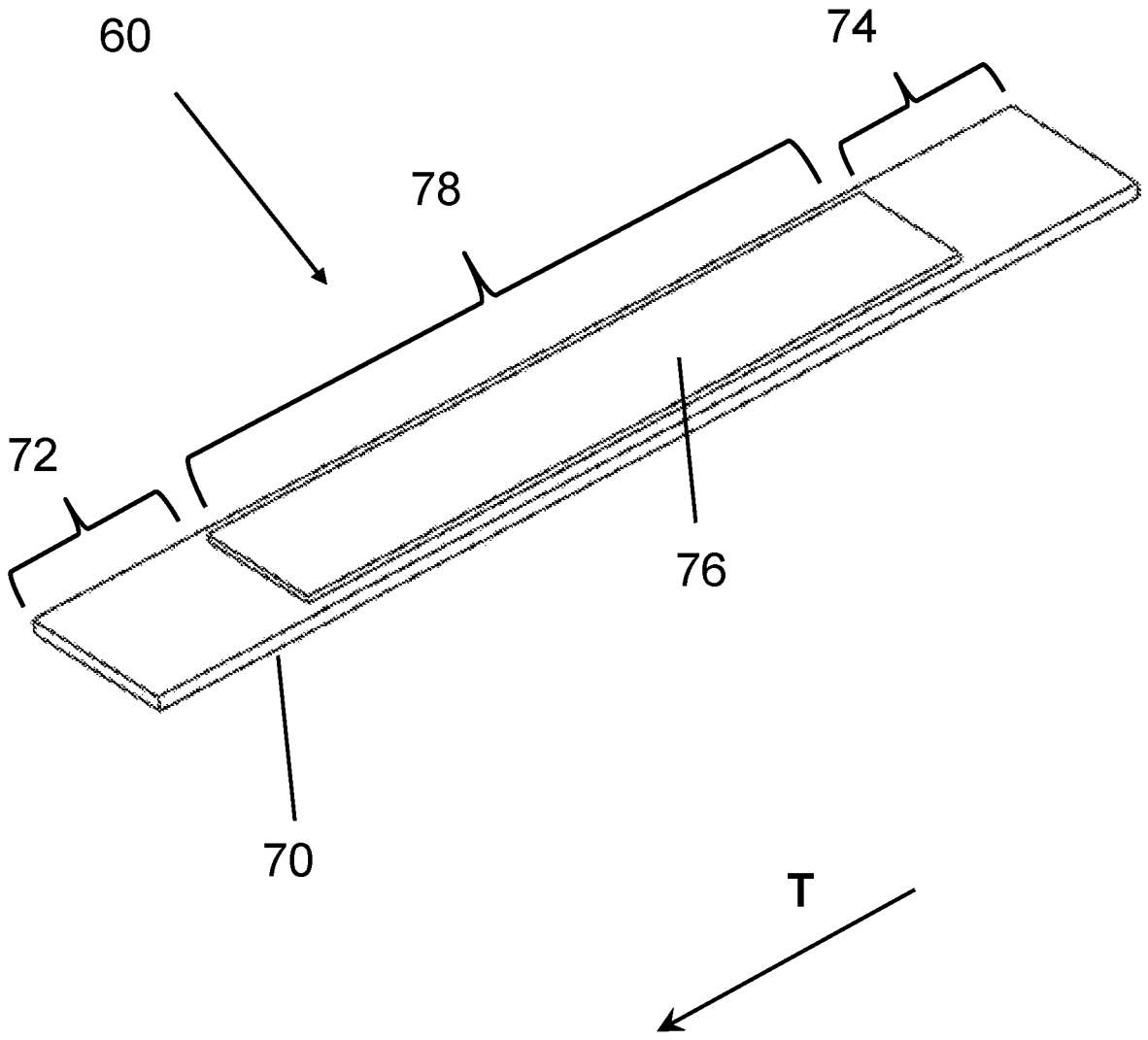
FIG. 11 shows a schematic drawing of a simpler version of the reinforcing component.
Figure 12:
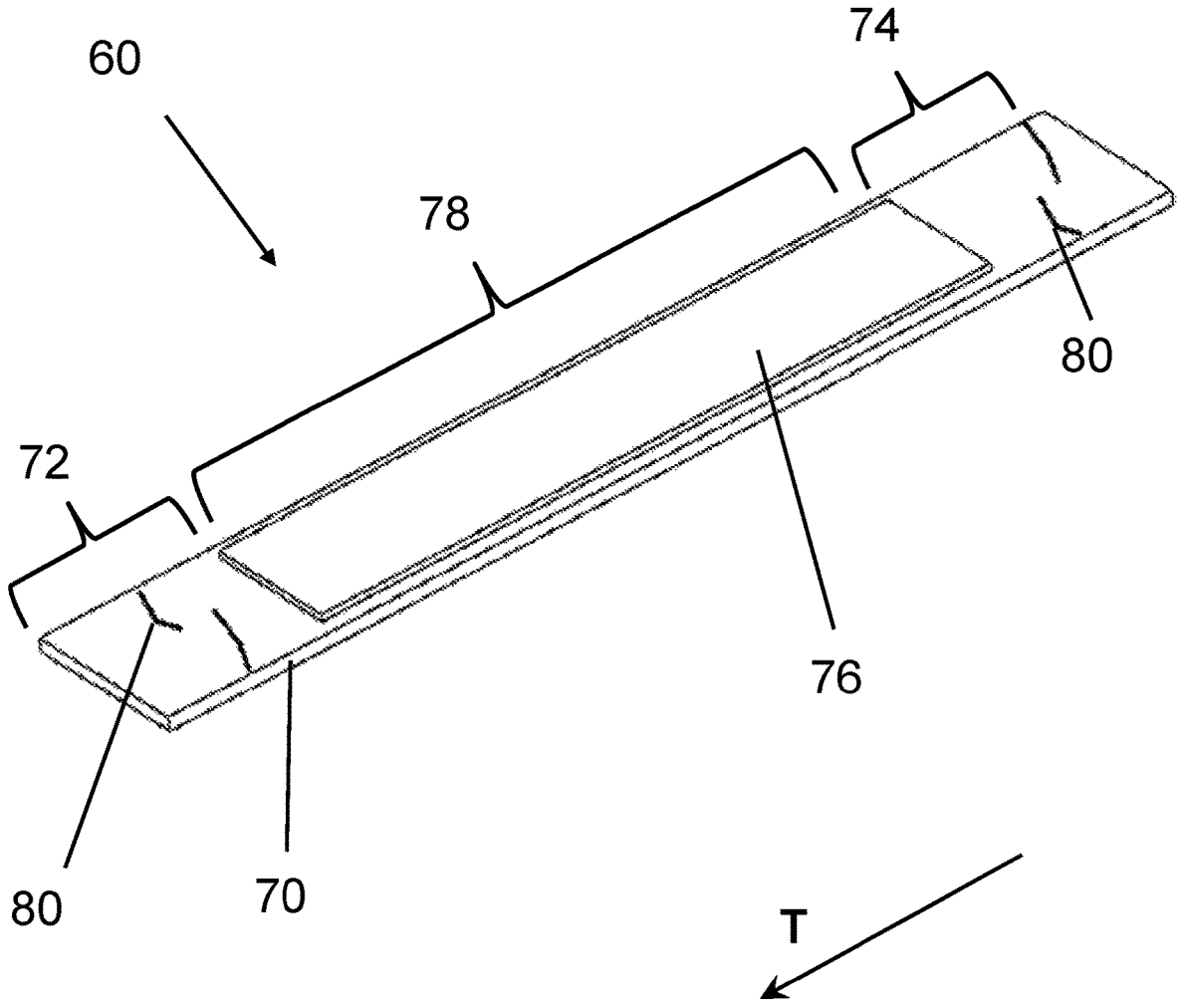
FIG. 12 shows a schematic drawing of a damaged reinforcing component.

FIG. 12 shows a schematic drawing of the reinforcing component 60 of FIG. 11 after it has sustained damage. Visible damage accumulation in the form of cracks 80 due to load transfer into the component after failure of a fastening bolt 62 is focused in the transparent or translucent first 72 and second 74 end portions of the first fibre-reinforced plastic layer 70 rather than in the central portion 78 which is strengthened by the second fibre-reinforced plastic layer 76. In other words, the reinforcing component 60 is deliberately configured to have weaker regions at the first 72 and second 74 end portions, to direct damage to accumulate in regions where it can be made visible upon inspection.

Figure 13:
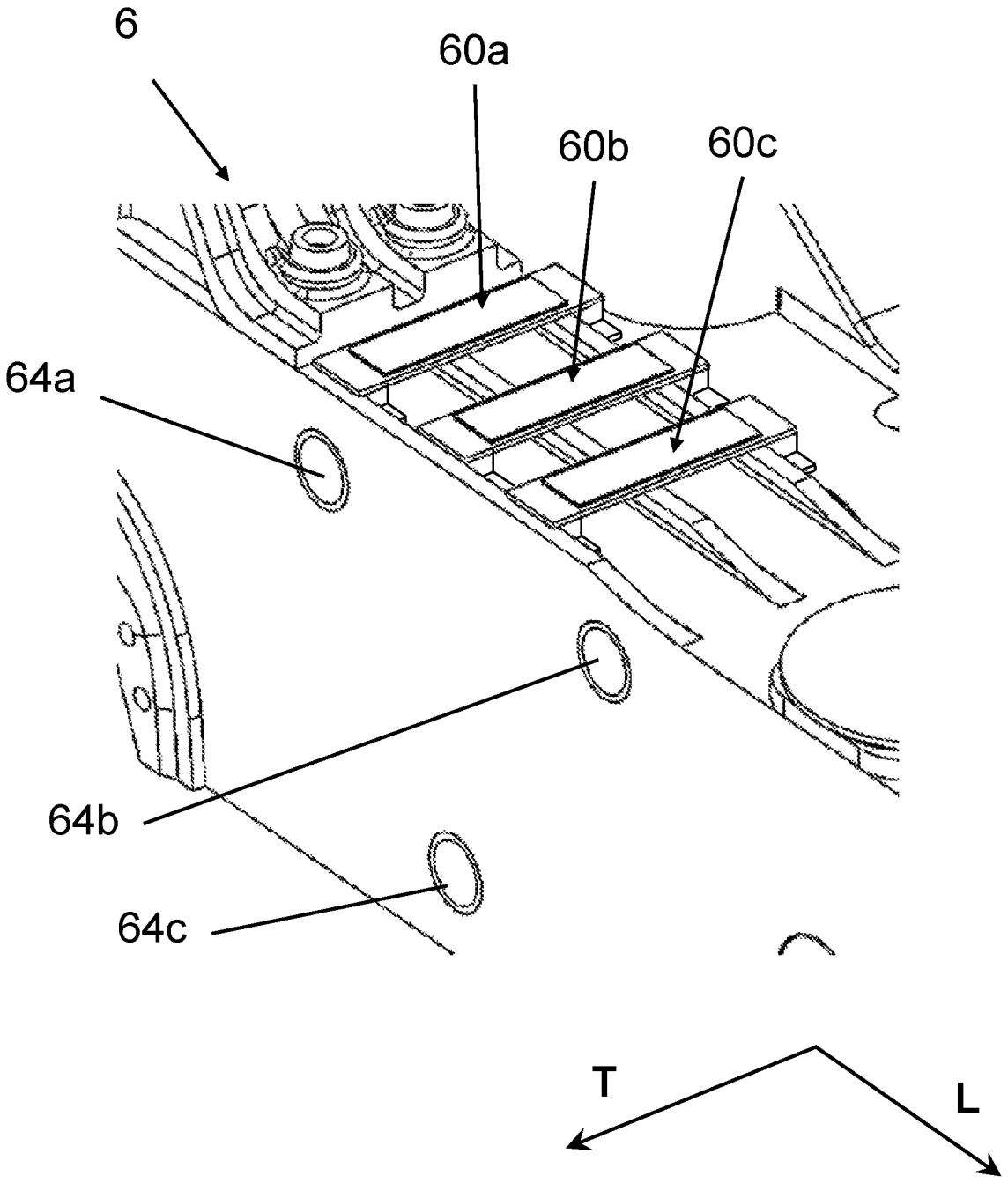
FIG. 13 shows a schematic drawing of part of the bogie frame of FIG. 9 having a plurality of reinforcing components.

FIG. 13 shows a schematic drawing of part of the bogie frame 6 in which a plurality of reinforcing components 60*a*, 60*b*, 60*c* of the simpler version are spaced at regular intervals in a row along a line of the joint between the structural members 14, 16. Each reinforcing component 60*a*, 60*b*, 60*c* extends parallel to and directly above a respective fastening bolt, the positions of which are indicated by their holes 64*a*, 64*b*, 64*c*.

In this configuration, the reinforcing components 60*a*, 60*b*, 60*c* can provide a visual indication of how the joint may be opening under bolt failure. For example, if the joint is opening more at the end of the row where reinforcing component 60*a* is located, then the expectation would be that the amount of visible damage accumulation would be greatest in the first and/or second end portions 72, 74 of reinforcing component 60*a*, and least in the first and/or second end portions 72, 74 of reinforcing component 60*c*. Conversely, if the joint is opening more at the other end of the row, then the expectation would be reversed, with greater amounts of visible damage accumulation in the first and/or second end portions 72, 74 of reinforcing component 60*c*. Related to this, the locations of the reinforcing components 60*a*, 60*b*, 60*c* may assist with identification of the fastening bolt which has failed. For example, if the fastening bolt at hole 64*a* fails, more of its load will tend to transfer to the closest reinforcing component 60*a* than to the other reinforcing components 60*b*, 60*c*. Consequently, the formation of cracks 80 in the first 72 and/or second 74 end portions of the closest reinforcing component 60*a* may be an indication that the fastening bolt in the first hole 64*a* has failed.

The reinforcing components 60 of the bogie frame 6 in FIG. 9 and the reinforcing components 60*a*, 60*b*, 60*c* of the bogie frame 6 in FIG. 13 are all shown being substantially identical to each other. However, a given bogie frame 6 may have reinforcing components 60 which exhibit different mechanical properties, e.g. different strengths. This can be useful to manage an uneven load distribution across the joint between the side member 14 and the centre member 16. For instance, if one fastening bolt 62 transmits a greater load than other fastening bolts, an adjacent reinforcing component may be correspondingly strengthened in order that it can accept a higher load transfer from that bolt in the event of bolt failure.

Figure 14:
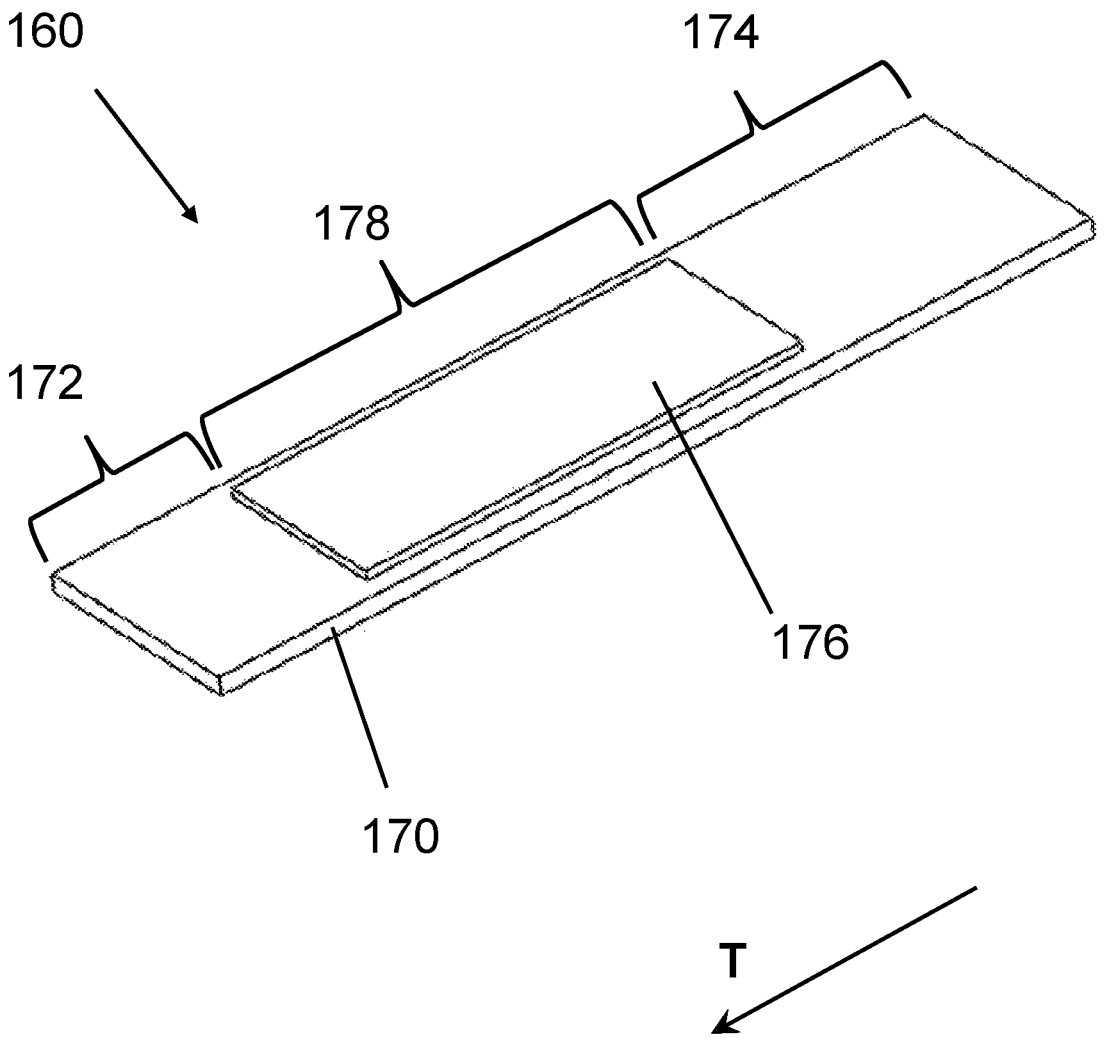
FIG. 14 shows a schematic drawing of a variant reinforcing component.

In FIGS. 9 to 13, the reinforcing components 60, 60*a*, 60*b*, 60*c* have equally sized first end portions 72 and second end portions 74. In contrast, FIG. 14 shows a variant, asymmetric reinforcing component 160 in which the first end portion 172 is smaller than the second end portion 174. The first fibre reinforcing plastic layer 170 has the same configuration as in FIG. 12, but in FIG. 14 the first end portion 172 extends from the central portion 178 over a shorter distance than the second end portion 174. In other words, the second fibre reinforcing plastic layer 176 is bonded to the first fibre reinforcing plastic layer 170 closer to the first end portion 172.

By such an adjustment, the load distribution in the reinforcing component 160 can be such that damage accumulation in the first end portion 172 is more concentrated and therefore easier to view than damage accumulation in the second end portion 174. Conveniently, the first end portion 172 can then be located at a more accessible location on the bogie frame 6, e.g. on an outer side of the bogie frame 6 attaching to the side member 14, rather than attaching to the less reachable centre member 16.

Figure 15:
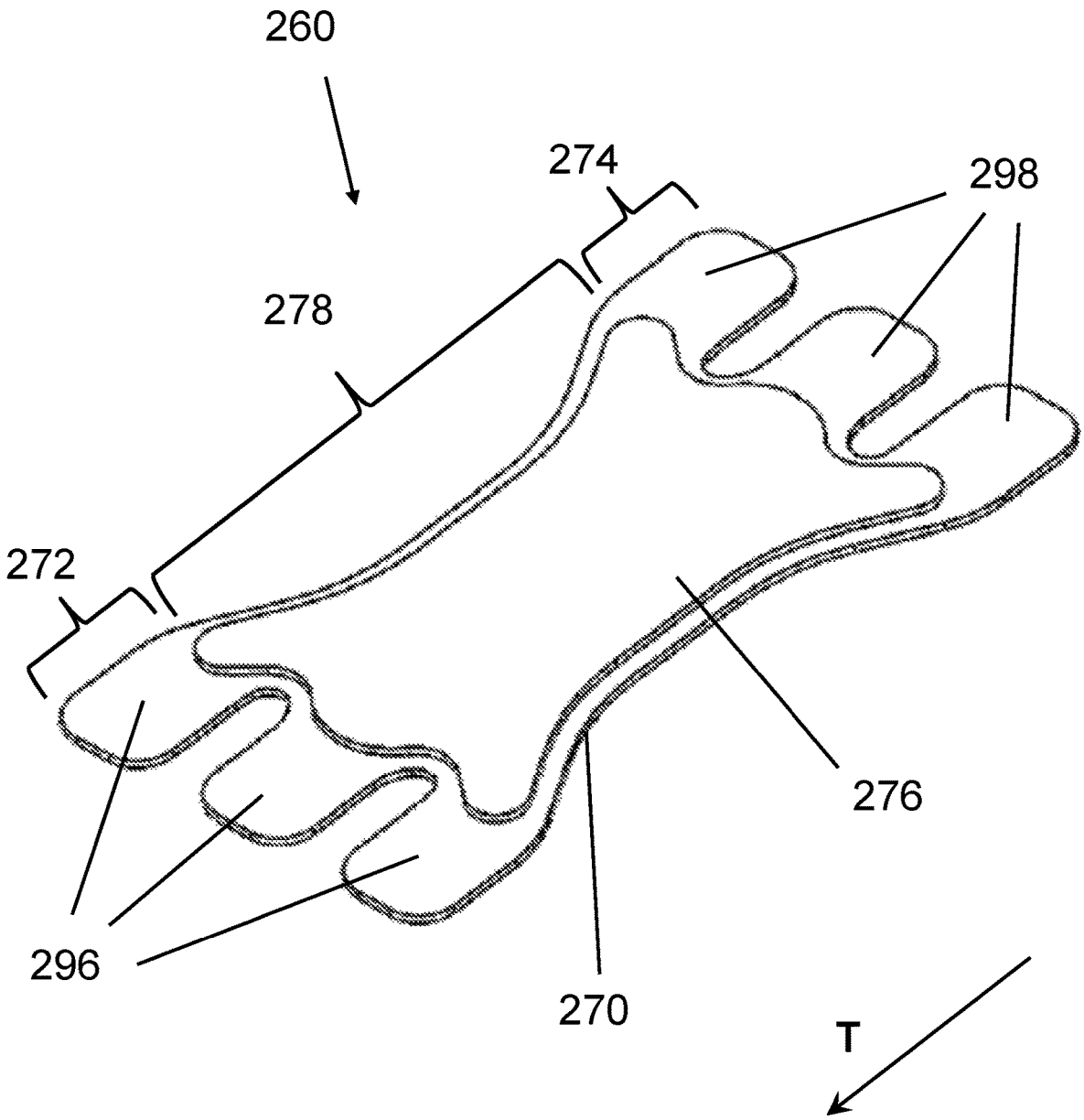
FIG. 15 shows a schematic drawing of a reinforcing component according to a further variant.

FIG. 15 shows a schematic drawing of a further variant reinforcing component 260 in which the first end portion 272 and the second end portion 274 spread out from a central waist and are each divided into a row of fingers 296, 298 for attaching to the respective structural member 14, 16. The fingers 296, 298 of each row can be spaced at regular intervals along the line of the joint between the first and second structural members 14, 16.

Like the row of reinforcing components 60*a*, 60*b*, 60*c* of FIG. 13 each row of fingers 296, 298 can then provide a visual indication of how the joint may be opening under bolt failure. For example, if the joint is opening more at one end of the row than the other, then there is an expectation that visible damage accumulation will be greater in the fingers closer to that end than in the other fingers. Similarly, if a given finger is closer to a fastening bolt 62 than the other fingers, then visible damage accumulation in that finger may be an indication of failure of that bolt.

Typically, the fingers 296, 298 of the first end portion 272 and the second end portion 274 are attached to the respective structural elements 14, 16 by distinct and separate adhesive bonds. Accordingly, interfacial failure of the adhesive bond of one of the fingers (e.g. a delamination crack) is then less likely to extend across to an adjacent finger.

Figure 16:
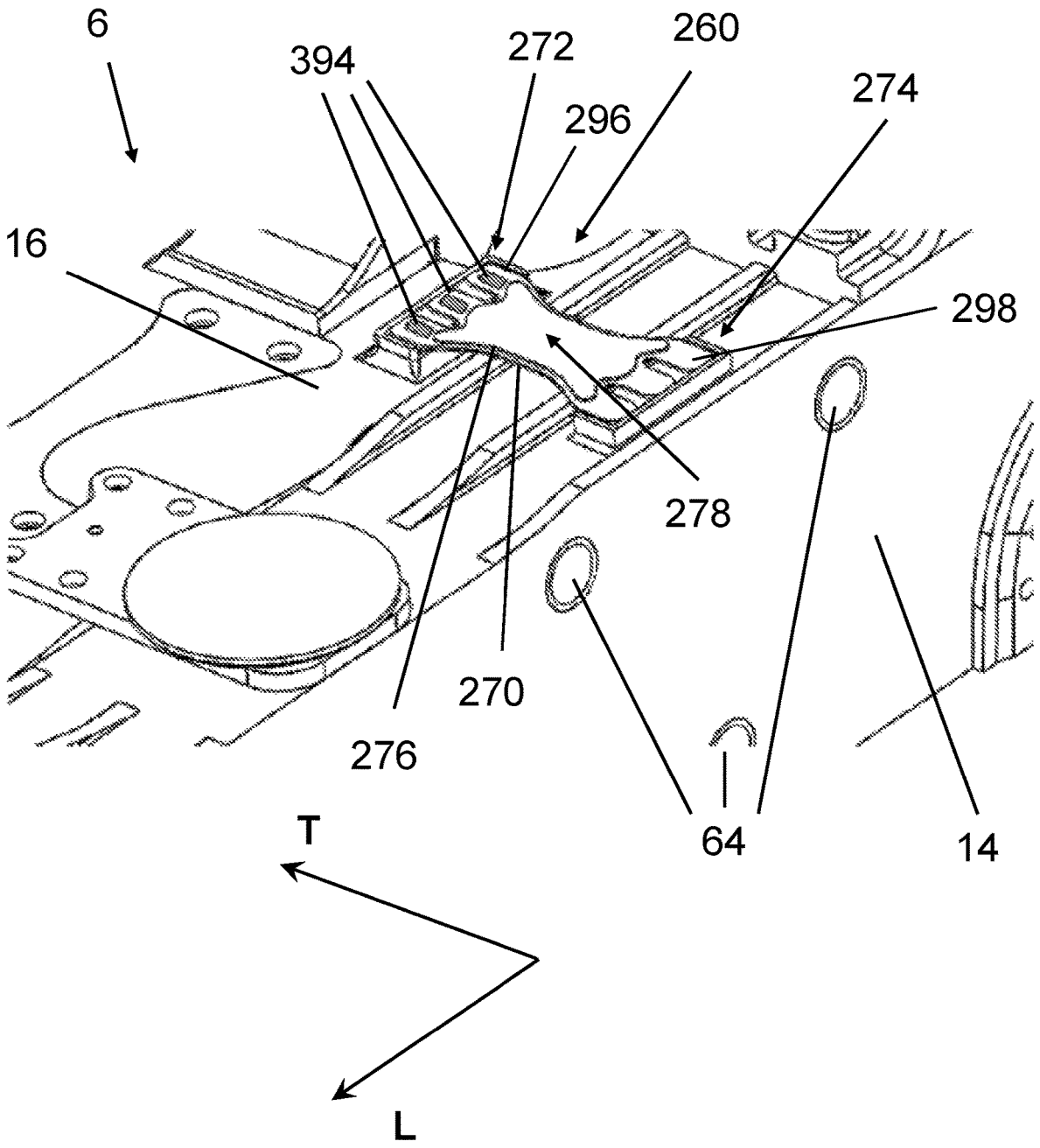
FIG. 16 shows a schematic drawing of part of the bogie frame of FIG. 9 having the reinforcing component according to FIG. 15.

FIG. 16 shows a schematic drawing of the bogie frame 6 including the reinforcing component 260 of FIG. 15. The fingers 296 of the first end portion 272 of the reinforcing component 260 are attached to the centre member 16 in a row along the line of the joint, and the fingers 268 of the second end portion 274 are attached to the side member 14 in a row along the line of the joint.

However, the fingers 296 of the first end portion 272, which are inward of the side member 14, also carry respective sensors 394, such as strain gauges, configured to monitor strain in the first end portion 272. In this way, the first end portion 272 can still be monitored despite being relatively inaccessible to visual inspection. The sensors 394 also enable the reinforcing component 260 to be monitored continuously, e.g. to obtain data of the load across the joint in real time. This can speed up diagnosis of fastening bolt failure.

Figure 17:
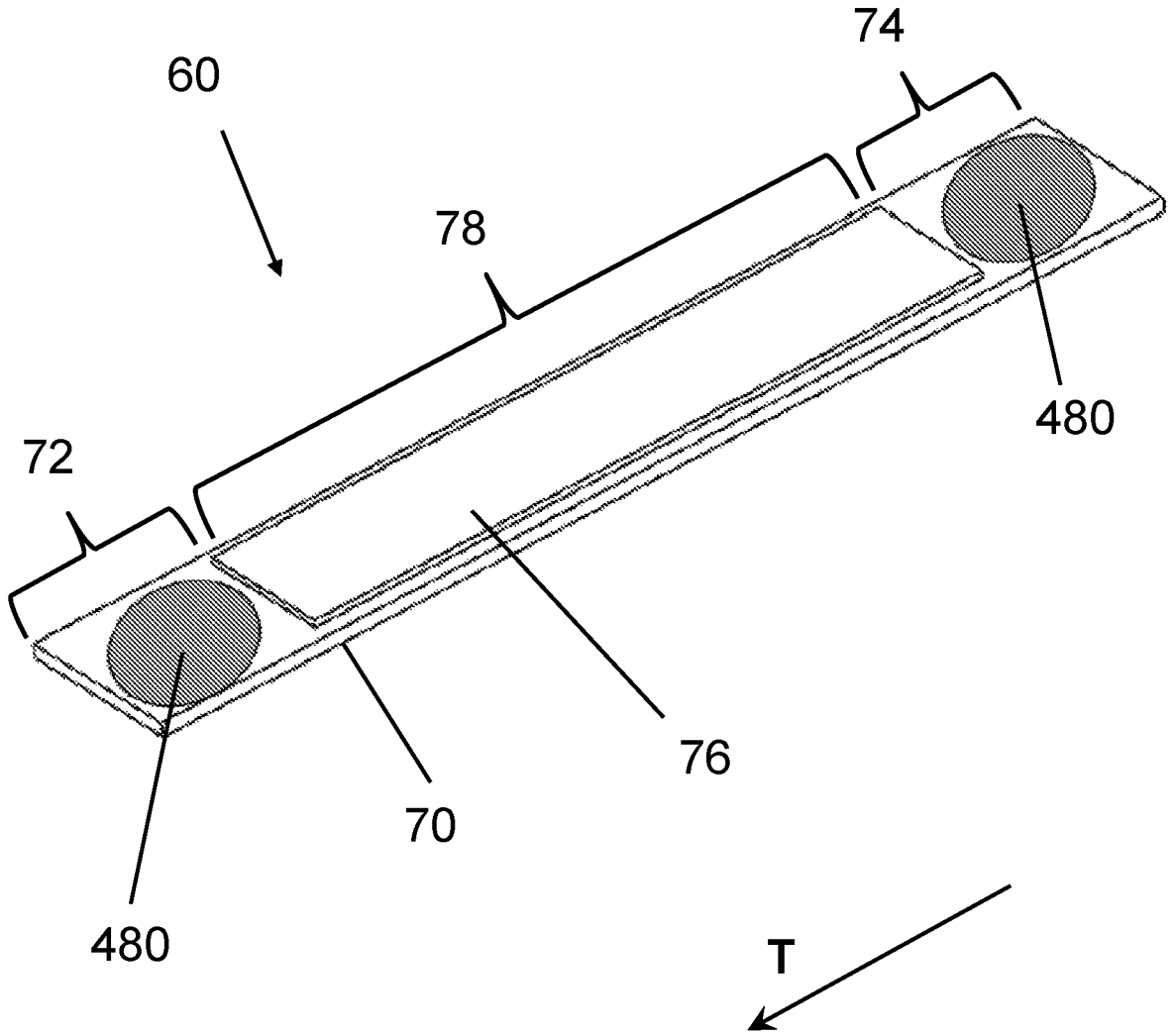
FIG. 17 shows a schematic drawing of the reinforcing component of FIG. 11 fitted with removable covers.

FIG. 17 shows a schematic drawing of the reinforcing component 60 of FIG. 11 but fitted with removable covers 480 to protect both the first end portion 72 and the second end portion 74. The removable covers 480 are configured to cover the otherwise exposed surface of the first fibre-reinforced plastic layer 70. The covers 480 prevent surface damage to or dirt accumulation on the end portions 72, 74 which could otherwise reduce or obscure the visibility of cracks 80 in the first fibre reinforce plastic layer 70. The covers 480 are removed for the performance of maintenance inspection of the end portions 72, 74, and are then refitted or replaced.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

The invention claimed is:

1. A bogie frame for a railway vehicle, the bogie frame comprising structural members defining the frame, and one or more reinforcing components joining the structural members, the or each reinforcing component comprising:

a first fibre-reinforced plastic layer having spaced first and second end portions, the first end portion attaching to a first structural member of the bogie frame, and the second end portion attaching to a second structural member of the bogie frame, wherein the first and second structural members are also joined together by one or more fastening bolts; and a second fibre-reinforced plastic layer disposed on a mid part of the first fibre-reinforced plastic layer between its first and second end portions such that the first and second end portions are left uncovered by the second fibre-reinforced plastic layer, wherein the second fibre-reinforced plastic layer forms with the mid part of the first fibre-reinforced plastic layer a central portion of the reinforcing component that is stronger than the first and second end portions, and wherein at least the first and second end portions of the first fibre-reinforced plastic layer are transparent or translucent.

2. The bogie frame according to claim 1, wherein the first fibre-reinforced plastic layer is made of a glass-fibre-reinforced plastic.

3. The bogie frame according to claim 1, wherein the second fibre-reinforced plastic layer is made of a carbon-fibre-reinforced plastic.

4. The bogie frame according to claim 1, wherein the first end portion is smaller than the second end portion.

5. The bogie frame according to claim 1, wherein the first and/or the second end portion is divided into a plurality of fingers which attach to the respective structural member.

6. The bogie frame according to claim 1, wherein the or each reinforcing component further comprises one or more sensors configured to monitor strain in the first and/or second end portions.

7. The bogie frame according to claim 1, wherein the or each reinforcing component further comprises a removable cover configured to protect an exposed surface of one of the first and second end portions.

8. A bogie frame according to claim 1, wherein the first and second end portions are adhesively bonded to respectively the first and second structural members.

9. The bogie frame according to claim 1, wherein the reinforcing component extends between the first and second end portions in a direction which is parallel to that of the one or more fastening bolts which join the first and second structural members.

10. The bogie frame according to claim 1, wherein the first structural member is one of a pair of side members, which when mounted on the railway vehicle, extend in a longitudinal direction of the railway vehicle and the second structural member is a centre member which, when mounted on the railway vehicle, extends in a transverse direction of the railway vehicle between the side members.

11. The bogie frame according to claim 1, wherein the first structural member and/or the second structural member is formed of aluminium alloy.

12. A method of monitoring the health of the bogie frame according to claim 1, the method including:

inspecting either or both of the transparent or translucent end portions of the reinforcing component for damage to the first fibre-reinforced plastic layer in the end portions; and determining that the joint between the first and second structural members is deteriorating when damage to the first fibre-reinforced plastic layer in the end portions is detected.

* * * * *